US007310976B1

(12) United States Patent
Renda

(10) Patent No.: US 7,310,976 B1
(45) Date of Patent: Dec. 25, 2007

(54) CIRCULAR KNITTING-MACHINE CHASSIS WITH CANTILEVER SUPPORT

(75) Inventor: James A. Renda, Waxhaw, NC (US)

(73) Assignee: Monarch Knitting Machinery Corp., Bronx, NY (US)

( * ) Notice: Subject to any disclaimer, the term of this patent is extended or adjusted under 35 U.S.C. 154(b) by 0 days.

(21) Appl. No.: 11/538,657

(22) Filed: Oct. 4, 2006

(51) Int. Cl.
*D04B 9/00* (2006.01)

(52) U.S. Cl. ..... 66/125 R

(58) Field of Classification Search ..... 66/8, 66/125 R, 131, 132 R, 132 T, 151
See application file for complete search history.

(56) References Cited

U.S. PATENT DOCUMENTS

| | | | | | |
|---|---|---|---|---|---|
| 116,677 | A | * | 7/1871 | Bradford | 66/164 |
| 1,581,093 | A | | 4/1926 | Howie | |
| 2,571,523 | A | * | 10/1951 | Bennett | 66/125 R |
| 2,803,739 | A | * | 8/1957 | Bentzen | 219/125.1 |
| 3,303,671 | A | | 2/1967 | Oliver, Jr. | |
| 3,521,466 | A | | 7/1970 | Tannert | |
| 3,589,146 | A | * | 6/1971 | Schmidt | 66/125 R |
| 3,596,851 | A | | 8/1971 | Vincoli | |
| 3,678,713 | A | * | 7/1972 | Woodford | 66/132 R |
| 3,805,556 | A | * | 4/1974 | Planck et al. | 66/125 R |
| 3,950,966 | A | | 4/1976 | di Carlo | |
| 3,959,991 | A | * | 6/1976 | Brown | 66/8 |
| 3,975,926 | A | | 8/1976 | Tenconi | |
| 4,026,127 | A | | 5/1977 | McCreary et al. | |
| D246,244 | S | | 11/1977 | Current et al. | |
| 4,363,225 | A | | 12/1982 | Marchisio | |
| 4,512,373 | A | * | 4/1985 | Trost | 66/125 R |
| 4,540,138 | A | * | 9/1985 | Gutschmit | 66/125 R |
| 4,580,418 | A | | 4/1986 | Yang | |
| 4,730,466 | A | * | 3/1988 | Tenconi | 66/125 R |
| 4,977,758 | A | | 12/1990 | Muir | |
| 5,050,405 | A | | 9/1991 | Jacobsson | |
| 6,082,143 | A | | 7/2000 | Noonkester et al. | |
| 6,219,136 | B1 | | 4/2001 | Kuo et al. | |
| 6,962,065 | B2 | | 11/2005 | Willmer | |
| 2002/0166346 | A1 | | 11/2002 | Pernick et al. | |

OTHER PUBLICATIONS

Santoni Seamless—Our Machines, Santoni Seamlessworld Our Machines, http://www.santoni.com/prodotti_eng.php?prodotto_id_choosed=24 on Feb. 2, 2006; 3 pages.

* cited by examiner

*Primary Examiner*—Danny Worrell
(74) *Attorney, Agent, or Firm*—Alston & Bird LLP

(57) ABSTRACT

A support chassis for a circular knitting machine includes a frame assembly having a leg assembly and a horizontal bed plate supported by the leg assembly, a support connected to the frame assembly, and a horizontal ring assembly entirely supported by the support in unbalanced cantilever fashion. The support may include a riser assembly and an extension assembly connected to the riser assembly. The extension assembly may be unbalanced about the riser assembly and extend away from the riser assembly in unbalanced cantilever fashion. The support may be connected to the leg assembly independently of the bed plate.

20 Claims, 8 Drawing Sheets

CIRCULAR KNITTING-MACHINE CHASSIS WITH CANTILEVER SUPPORT

FIELD OF THE INVENTION

Embodiments of the present invention relate generally to circular knitting machines. More particularly, embodiments of the invention relate to a support chassis for a circular knitting machine wherein a cantilever support bears a ring assembly.

BACKGROUND OF THE INVENTION

A circular knitting machine 10 according to the prior art is shown in FIG. 1. The circular knitting machine 10 comprises a raised horizontal bed plate 12 that supports a cam-retaining ring 14. A revolving gear ring rotatably supported by a ball race resides between the cam-retaining ring and the bed plate. A knitting cylinder surrounded by a cylindrical cover assembly 16 supports knitting elements such as pivoting cams and reciprocating needles that are actuated by the revolving gear ring when the machine 10 is operated to produce tubular knitted fabric. The fabric passes down through the knitting cylinder and bed plate as knitting proceeds and is generally collected on a roll that revolves about a horizontal axis within the lower housing 18 of the knitting machine.

A ring assembly 20 supports multiple active yarn feeders 22 that provide yarns for the knitting of fabric. The yarn feeders pull yarn from passive creels (not shown) and provide the yarn to the knitting cylinder. The yarns extending from the yarn feeders to the knitting cylinder are controllably tensioned by the feeders to maintain quality and consistency as knitted tubular fabric is produced.

The ring assembly 20 is supported by a plurality of upright support members 24. Typically, three or four upright support members support the ring assembly. Three support members 24 are particularly shown to support the ring assembly in FIGS. 1 and 2 in order to provide a particular example of a known circular knitting machine. The multiple support members that support the ring assembly are connected to and are supported at least in part by the cam-retaining ring 14 and the bed plate 12. Though this arrangement, which is typical among prior knitting machines, is sturdy and reliable, certain inconveniences and inefficiencies have been recognized in both frequent production activities and in less frequent activities that entail configuring and servicing the machine.

A frequent production activity is illustrated in FIG. 2, wherein a technician struggles to prepare the knitting machine for operation by stringing yarns from the active yarn feeders to the knitting cylinder. This activity is a regular task in operating circular knitting machines and is sometimes called "knitting down" the machine. The activity of the technician is inconveniently obstructed by the support members 24 as the technician works his way around the machine. As the technician reaches around a support member in FIG. 2, the work becomes particularly tedious and can entail bumps and bruises to the arms and forehead of the technician as he contacts the support member. The technician repeatedly experiences these difficulties as he knits down the machine and encounters the multiple support members 24.

Beyond frequent production activities, activities toward configuring and servicing the circular knitting machine can entail accessing the knitting cylinder and other components within the cover assembly 16 and below the cam-retaining ring 14 (FIG. 1). The multiple support members 24 are supported at respective locations by the cam-retaining ring 14 and the bed plate 12. When internal components of the machine are to be serviced in place, difficulties arise because the multiple support members obstruct access to the internal components much like they obstruct knitting down activities in FIG. 2. The multiple support members 24 together surround and in a sense cage the knitting cylinder. Thus, if a knitting cylinder is to be removed from the knitting machine, one or more of the support members must typically be removed from the machine while the ring assembly 20 is supported by a crane or other support means disposed above the ring assembly. If the revolving gear ring and ball race residing between the cam-retaining ring and the bed plate are to be accessed for cleaning or service, then typically all of the multiple support members 24 must be removed from the machine because the support members and ring assembly are supported at least in part by the cam-retaining ring and bed plate.

Therefore, improvements are needed toward supporting the ring assembly of a circular knitting machine by some arrangement that allows convenient knitting down activities and servicing activities.

BRIEF SUMMARY OF THE INVENTION

Embodiments of the invention may address at least some of the above needs and achieve other advantages. For example, an aspect of the invention relates to a support chassis for a circular knitting machine, which support chassis includes a frame assembly, a support connected to the frame assembly, and a horizontal ring assembly entirely supported by the support in unbalanced cantilever fashion. The frame assembly includes a leg assembly and a horizontal bed plate supported by the leg assembly. The ring assembly is capable of supporting multiple yarn feeders above the bed plate for providing yarn for the knitting of tubular knitted fabric.

In at least one embodiment according to this aspect of the invention, the support includes a riser assembly connected to the frame assembly, and an extension assembly connected to the riser assembly. The riser assembly has at least a portion that is at least partially vertically disposed. The extension assembly has at least a portion that is at least partially horizontally disposed. The extension assembly at least partially supports the ring assembly. Furthermore, in at least one embodiment of the support chassis, the extension assembly is unbalanced about the riser assembly and extends away from the riser assembly in unbalanced cantilever fashion. The riser assembly may comprise a single pedestal member that entirely supports the extension assembly and the ring assembly. The riser assembly may include multiple pedestal members that together entirely support the extension assembly and the ring assembly. The extension assembly may include a plurality of arms connected to a hub. The extension assembly may include a horizontally disposed planar member.

For further example, another aspect of the invention relates to a support chassis for a circular knitting machine, which support chassis includes a frame assembly, a cantilever support connected to the frame assembly at a single location, and a horizontal ring assembly entirely supported by the cantilever support. The frame assembly includes a leg assembly and a horizontal bed plate supported by the leg assembly. The bed plate defines an aperture for the downward passage of tubular knitted fabric. The cantilever support has no portion passing through the aperture. The ring assembly is capable of supporting multiple yarn feeders above the bed plate for providing yarn for the knitting of tubular knitted fabric.

In at least one embodiment according to this aspect of the invention, the cantilever support includes a riser assembly connected at the single location to the frame assembly, and an extension assembly connected to the riser assembly. The riser assembly has at least a portion that is at least partially vertically disposed. The extension assembly has at least a portion that is at least partially horizontally disposed. The extension assembly at least partially supports the ring assembly. Furthermore, in at least one embodiment, the extension assembly is unbalanced about the riser assembly and extends away from the riser assembly in unbalanced cantilever fashion. The extension assembly may extend away from the riser assembly and toward a vertical axis that passed through the aperture defined by the bed plate. The riser assembly may comprise a single pedestal member that entirely supports the extension assembly and the ring assembly. The riser assembly may include multiple proximately disposed pedestal members, each attached at the single location to the frame assembly, that together entirely support the extension assembly and the ring assembly. The extension assembly may include three horizontally disposed arms connected together in a Y-shaped configuration. The leg assembly may include multiple support legs, one of which may include an abutment disposed at the single location, which abutment entirely supports the cantilever support and the ring assembly.

BRIEF DESCRIPTION OF THE SEVERAL VIEWS OF THE DRAWINGS

Figure 1:
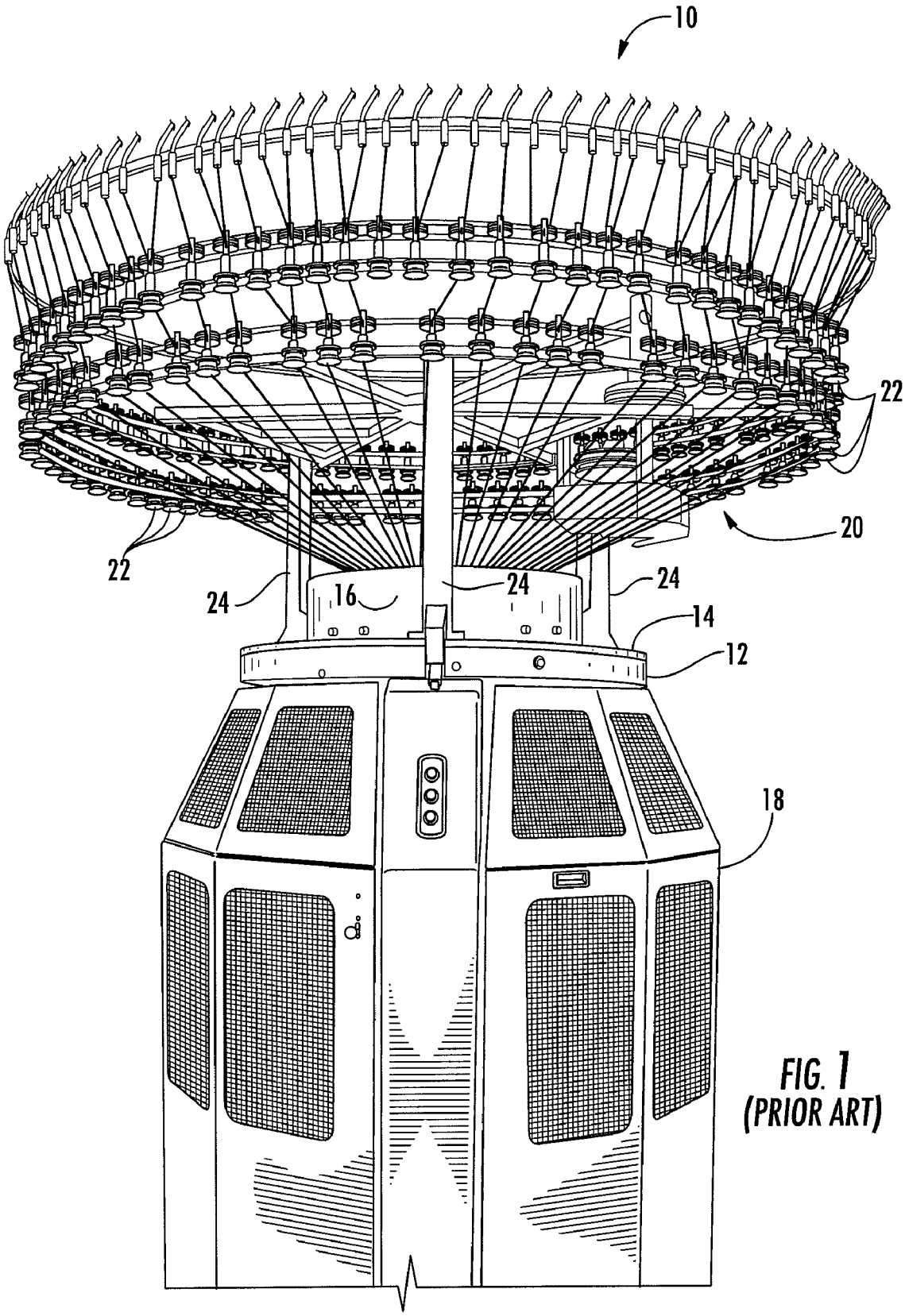
FIG. 1 (PRIOR ART)
Figure 2:
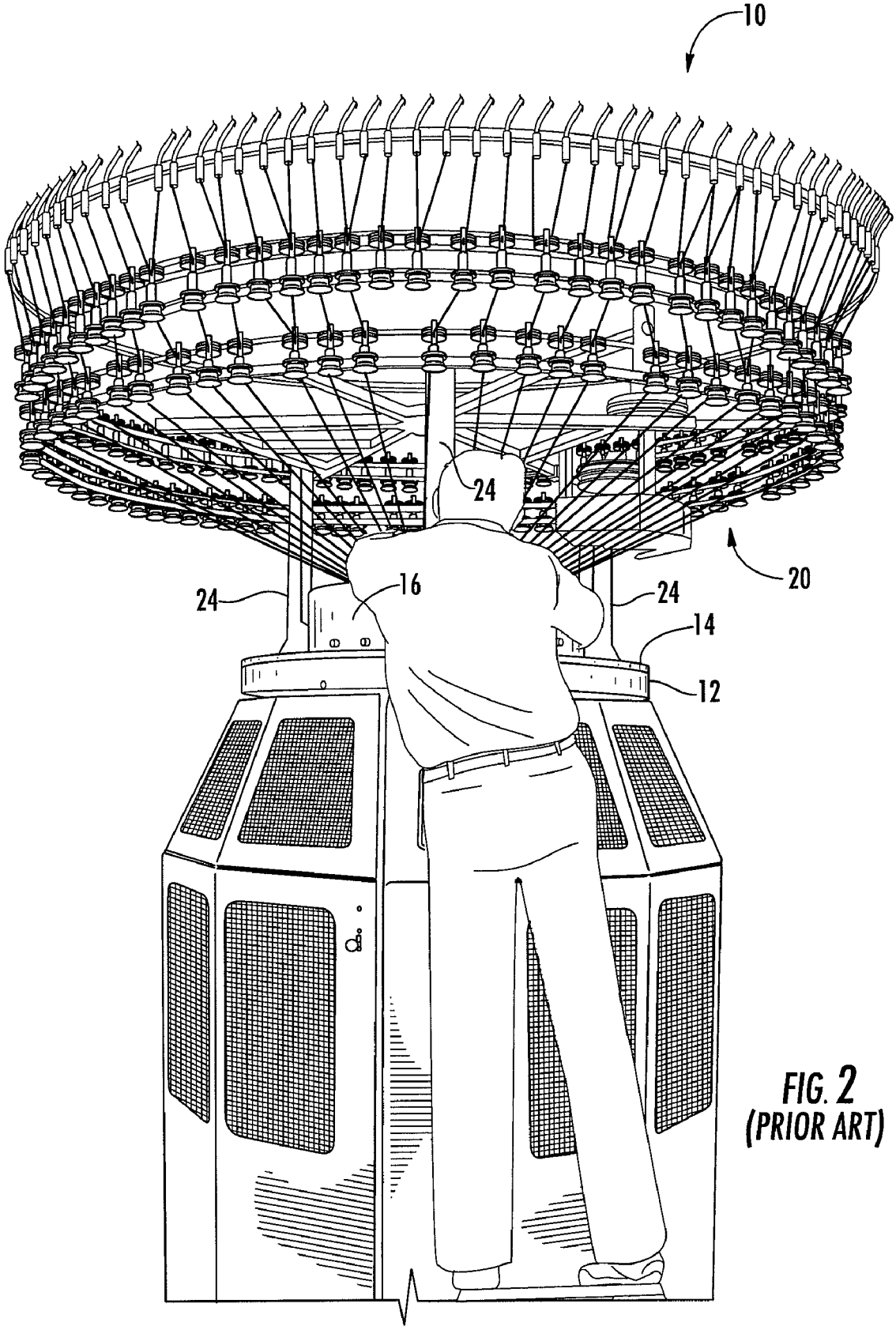
FIG. 2 (PRIOR ART)
Figure 3:
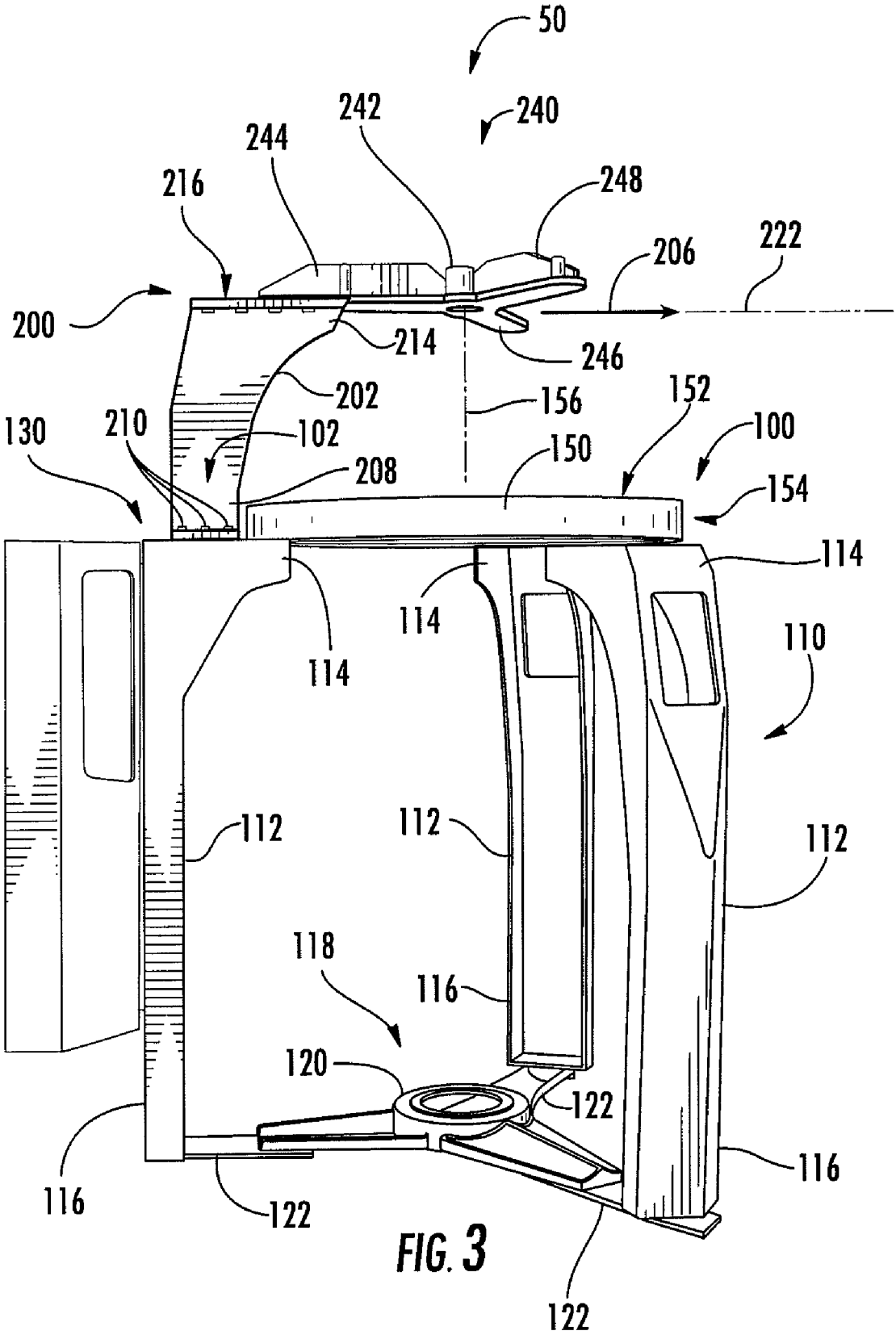
Figure 4:
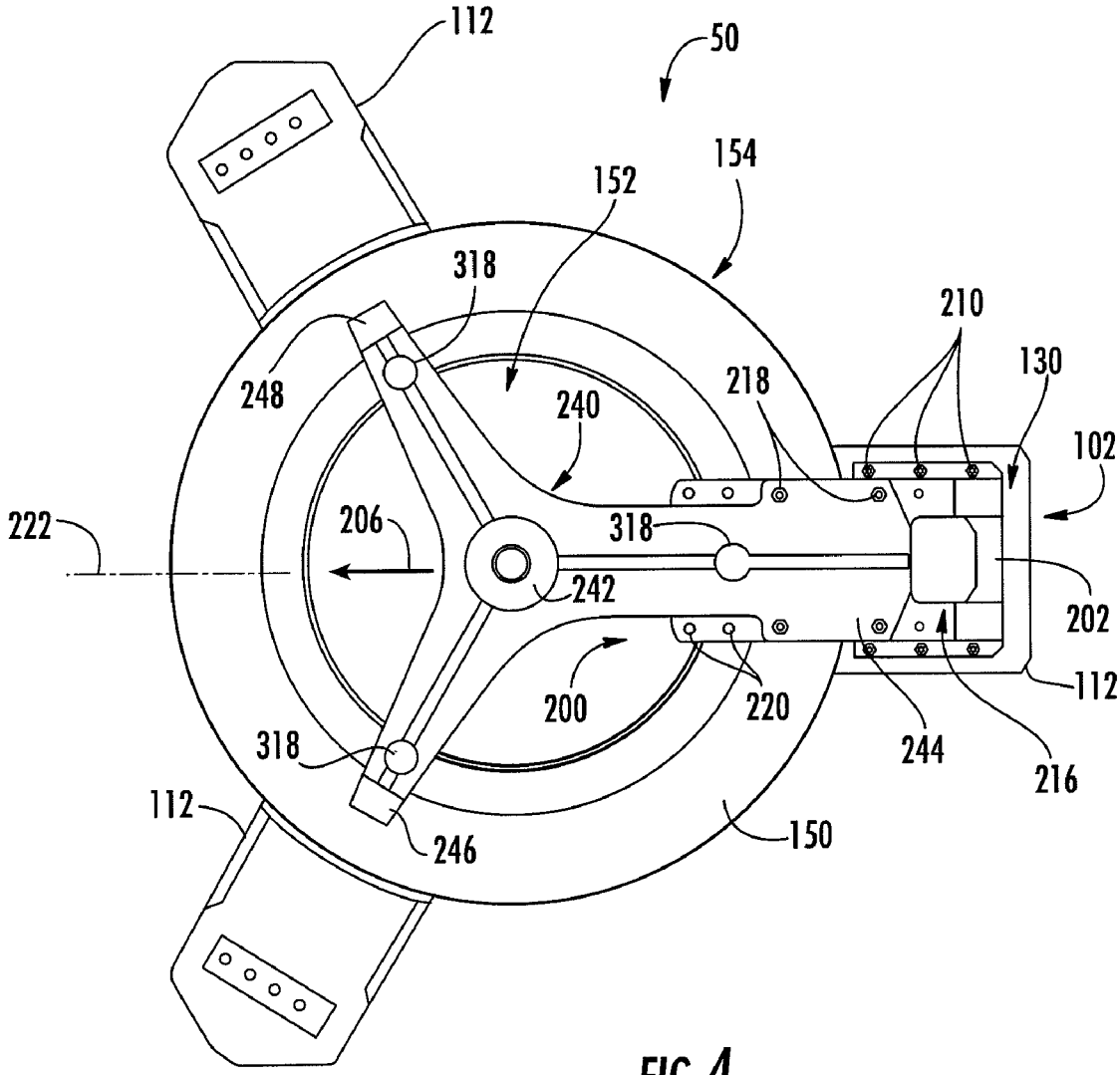
Figure 5:
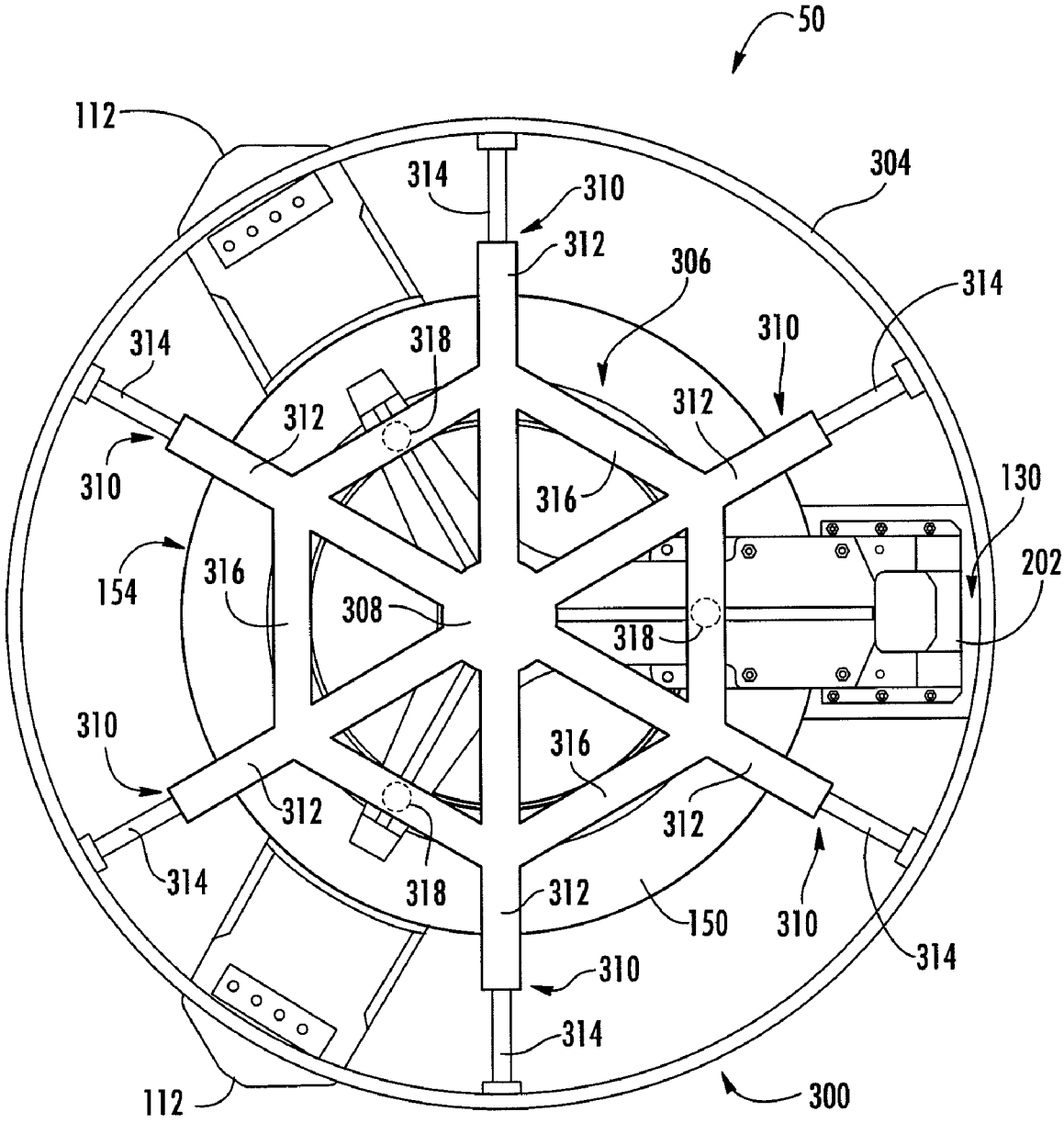
Figure 6:
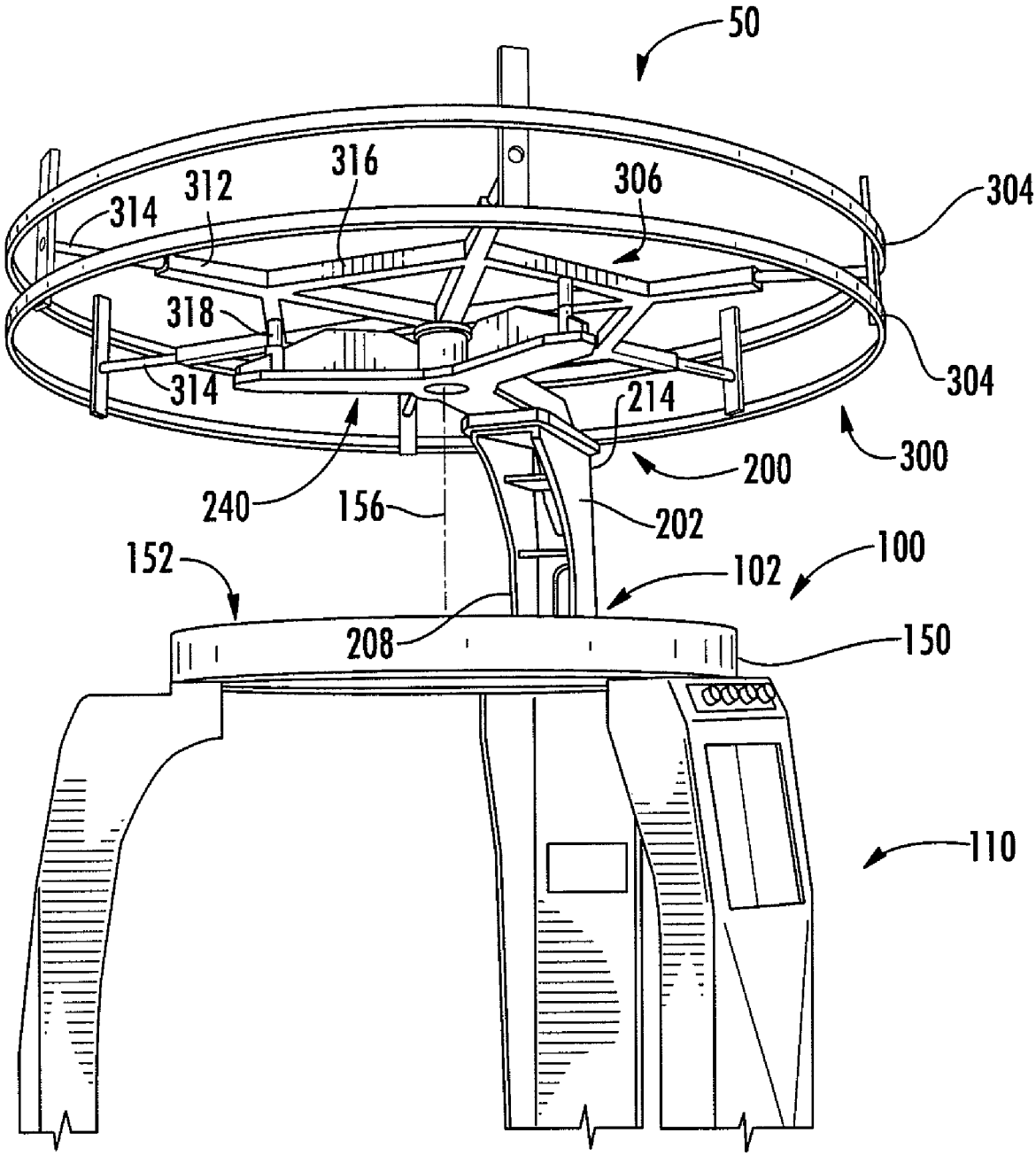
Figure 7:
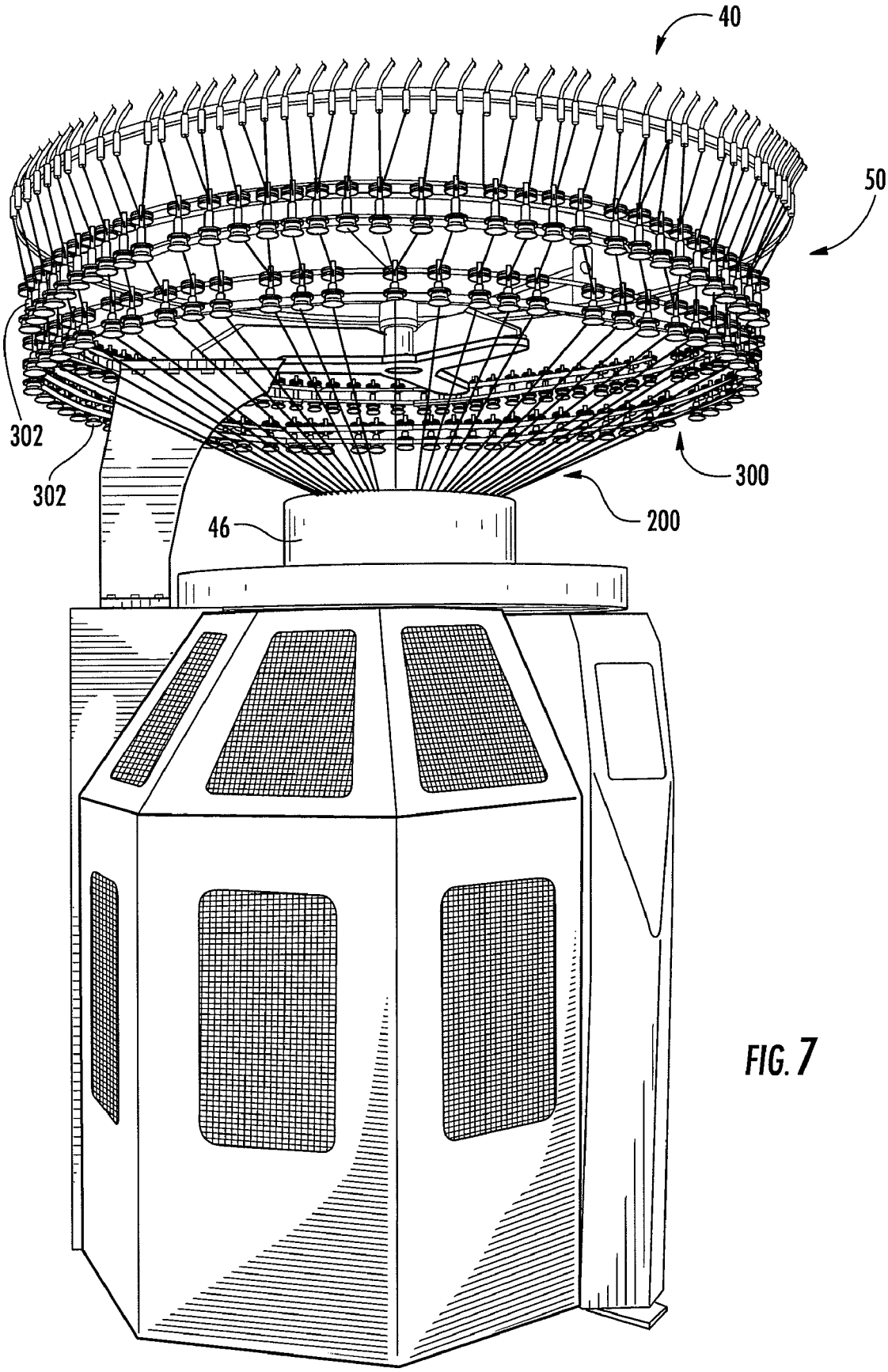
Figure 8:
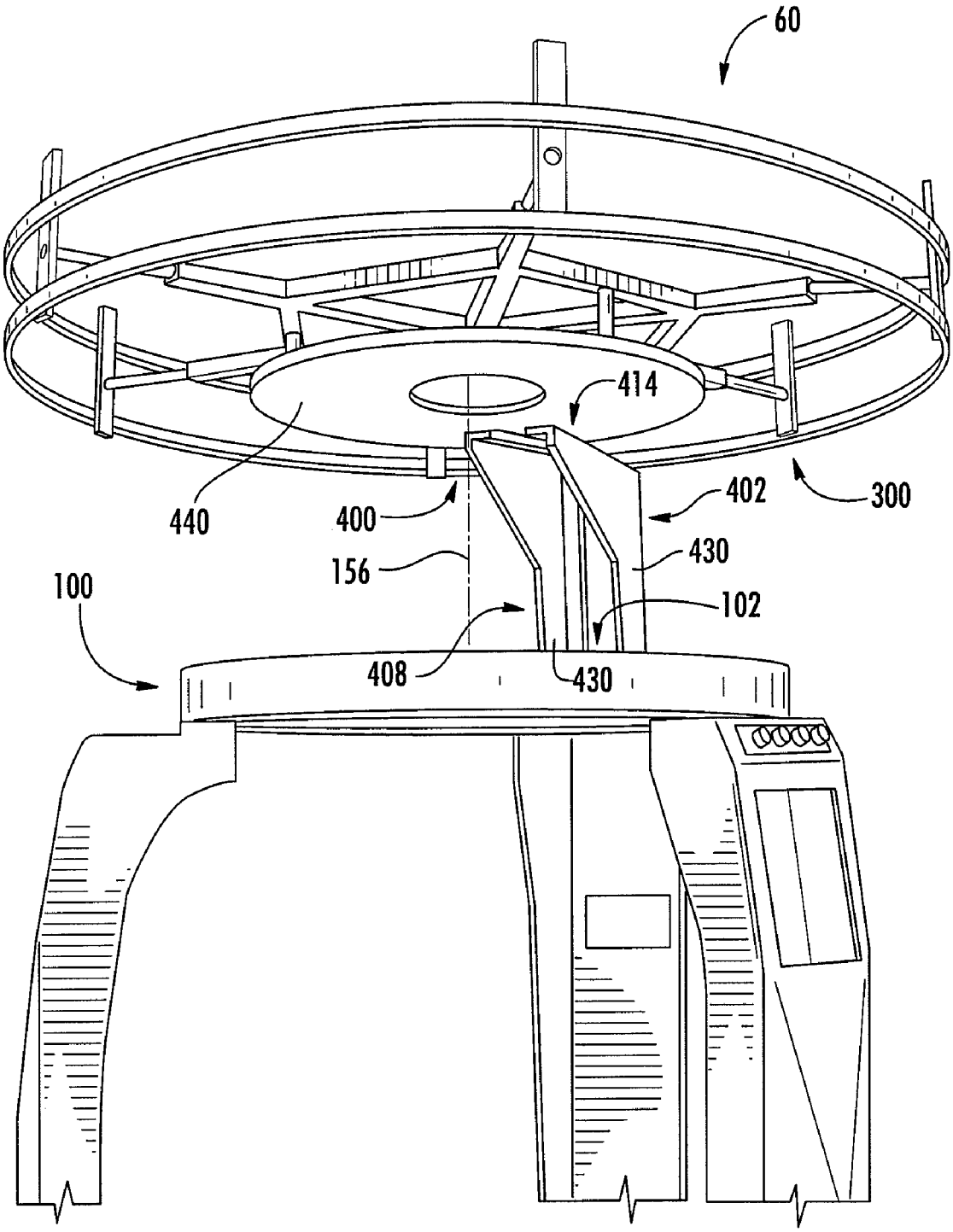

Having thus described the invention in general terms, reference will now be made to the accompanying drawings, which are not necessarily drawn to scale, and wherein:

FIG. 1 is a perspective view of a prior-art circular knitting machine having multiple upright support members supporting a ring assembly;

FIG. 2 is a perspective view of a technician knitting down the prior-art machine of FIG. 1 and encountering the multiple support members;

FIG. 3 is a perspective view of a partially assembled support chassis for a circular knitting machine, the support chassis shown according to at least one embodiment of the invention, and shown without the ring assembly thereof;

FIG. 4 is a plan view taken above the partially assembled support chassis of FIG. 3;

FIG. 5 is a plan view taken above the support chassis of FIG. 3, shown with the ring assembly installed;

FIG. 6 is a perspective view of upper portions of the support chassis of FIG. 3, shown with the ring assembly installed;

FIG. 7 is a perspective view of a circular knitting machine assembled about the support chassis of FIGS. 3-6; and FIG. 8 is a perspective view of upper portions of a support chassis for a circular knitting machine, the support chassis shown according to at least one other embodiment of the invention.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

A novel support chassis 50 according to an embodiment of the invention is illustrated in various stages of assembly in FIGS. 3-6. The support chassis 50 includes a frame assembly 100, a support 200 connected to the frame assembly, and a horizontal ring assembly 300 (FIGS. 5-6). The frame assembly 100 includes a leg assembly 110 and a horizontal bed plate 150 supported by the leg assembly. The support 200 resists bending moments and shear forces and thus defines a cantilever support by entirely supporting the ring assembly in unbalanced cantilever fashion.

The cantilever support 200 is connected to the frame assembly 100 at a single location 102 and has no portion passing through an aperture 152 defined by the bed plate for the downward passage of tubular knitted fabric. Thus, the support chassis 50 provides free working space between the frame assembly 100 and the ring assembly 300. This can be appreciated by viewing the circular knitting machine 40 shown assembled about the support chassis 50 in FIG. 7. The knitting machine 40 in FIG. 7 has been knitted down with considerably less difficulty than that experienced by the technician knitting down the knitting machine 10 in FIG. 2, which technician encounters multiple members 24.

As shown in FIG. 3, the leg assembly 110 includes multiple support legs 112 that support the bed plate 150. Upper ends 114 of the support legs are maintained in their relative dispositions by the bed plate. Lower ends 116 of the support legs are connected to an adjustable base assembly 118. The base assembly comprises a central base bracket 120 and extension plates 122 that extend radially from the central base bracket. Each extension plate is connected to the lower end of a respective support leg. Each extension plate is adjustably connected to the base bracket and adjustably extends radially therefrom to accommodate a variety of bed plate sizes while maintaining the support legs in at least approximately vertical dispositions. A particular one of the support legs 112 comprises an abutment 130 disposed at the single location 102 at which the cantilever support 200 is connected to the frame assembly 100. The abutment 130 entirely supports the cantilever support 200 and the ring assembly 300.

The bed plate 150 defines an outer perimeter 154 and the aperture 152. As shown in FIG. 4, the bed plate 150 is configured as an annular member such that the outer perimeter 154 and the aperture 152 are concentrically arranged about a central vertical axis 156 (FIGS. 3,5) that passes through the aperture 152. Furthermore, the single location 102 at which the cantilever support 200 is connected to the frame assembly 100 is disposed beyond the outer perimeter 154 such that the cantilever support 200 is connected to the frame assembly 100 independently of the bed plate as shown in FIGS. 3-4.

As shown in FIGS. 5-6, the ring assembly 300 is connected to and entirely supported by the cantilever support 200. The ring assembly is capable of supporting multiple yarn feeders 302 above the bed plate for providing yarn for the knitting of tubular knitted fabric when a knitting machine 40 is assembled and operated about the support chassis as shown in FIG. 7. The ring assembly 300 comprises rings 304 (FIG. 6) and a framework 306 connected to and supported by the cantilever support 200 while the rings 304 are connected to and supported by the framework. The framework comprises a central hub 308 (FIG. 5) and radially disposed telescoping members 310 connected to the hub at regular angular intervals. The telescoping members comprise fixed first members 312 connected to the hub and adjustable second members 314 connected to and supporting the rings 304. The second members 314 extend adjustably outward from the fixed first members 312 to accommodate rings having various diameters. As shown in FIG. 5, the framework 306 further comprises tangentially disposed stiffening members 316 connected between adjacent telescoping members 310 providing stability and rigidity to the framework. As shown in FIGS. 4 and 6, posts 318 connect the stiffening members to the cantilever support 200. The framework and rings are entirely supported by the cantilever support.

Two particular embodiments of inventive cantilever supports are described in the following with references to the respective figures that particularly illustrate the embodiments. Specifically, FIGS. 3-6 illustrate an embodiment referenced as cantilever support 200, and FIG. 8 illustrates an embodiment referenced as cantilever support 400. Accordingly, FIGS. 3-6 illustrate, in various stages of assembly, an inventive support chassis 50 that comprises the cantilever support 200. FIG. 8 illustrates an inventive support 60 that comprises the cantilever support 400. It should be understood that other embodiments of inventive support chassis and inventive cantilever supports are intended to be included within the scope of the appended claims. Thus, descriptions herein of the two embodiments of inventive cantilever supports are provided merely as examples in order to support an understanding of various embodiments of the invention. For the sake of brevity, the above descriptions of the frame assembly 100 and the ring assembly 300 relate equally to the two particular embodiments of cantilever supports.

Regarding FIGS. 3-6, wherein the support chassis 50 is illustrated in various stages of assembly, the cantilever support 200 includes a riser assembly 202 that is generally vertically disposed, and an extension assembly 240 that is generally horizontally disposed. The extension assembly is unbalanced about the riser assembly and extends away from the riser assembly in unbalanced cantilever fashion. In order to support the ring assembly 300 (FIGS. 5-7) above the bed plate, the extension assembly extends at least partially in the direction 206 (FIGS. 3,4) toward the central vertical axis 156 that passes through the aperture of the bed plate. The riser assembly 202 has a lower end 208 that is connected at the single location 102 to the frame assembly, for example, by a number of bolts 210 (FIG. 4). The riser assembly 202 has an upper end 214 that is connected to the extension assembly 240. When assembled with the ring assembly, the extension assembly is further connected to and entirely supports the ring assembly 300 as shown in FIGS. 5-7. The riser assembly entirely supports the extension assembly and ring assembly 300 in unbalanced cantilever fashion.

The riser assembly 202 is constructed as a unitary pedestal member that entirely and solely supports the extension assembly 240 and the ring assembly 300. As illustrated in FIG. 6, the riser assembly 202, or unitary pedestal member, defines a skeletonized frame that is rigid and resists downward forces and bending moments applied by the extension assembly. The riser assembly entirely supports the extension assembly 240, and the ring assembly 300 in unbalanced cantilever fashion. As shown in FIGS. 3-4, the riser assembly 202 comprises an abutment 216 to which the extension assembly 240 is connected, for example, by a number of bolts 218 (FIG. 4). A series of holes 220 defined in the abutment 216 of the riser assembly receives the bolts 218 that connect the extension assembly 240 to the riser assembly 202. The positions of the holes define a series of positions of the extension assembly relative to the riser assembly. Thus, the extension assembly is adjustably connected to the riser assembly such that the extension assembly, and the ring assembly connected thereto in FIGS. 5-7, are capable of being adjustably disposed along a horizontal axis 222. In assembling the support chassis 50, the ring assembly is typically disposed to appear concentric with the bed plate when viewed from overhead as shown in FIG. 5.

As particularly shown in FIGS. 3 and 4, the extension assembly 240 is constructed as an arm assembly that comprises a hub 242 and a plurality of arms, namely arms 244, 246, and 248, that are connected together by the hub. A single one of the arms, namely the arm 244, is connected to the riser assembly, for example, by the bolts 218. The extension assembly 240, or arm assembly, is entirely supported by the single arm 244. As shown in FIG. 4, the hub 242 of the extension assembly is disposed above the inner aperture 152 of the bed plate 150. The arms 244, 246, and 248 are generally horizontally disposed and extend radially from the hub 242. The arms 246 and 248 extend freely from the hub while the arm 244 is connected to the riser assembly. The arms 246 and 248 extend from the hub with symmetry relative to the arm 244 to define a Y-shaped horizontal configuration. More particularly, the arms are connected to the hub at regular angular intervals. The extension assembly is illustrated having three arms such that a regular angular interval of approximately one hundred and twenty degrees is defined between each adjacent pair of the three arms 244, 246, and 248. These descriptions nonetheless relate to arm assemblies having arms disposed at other angular intervals. For example, one particular embodiment of a novel support chassis according to the invention includes an arm assembly having four arms wherein a regular angular interval of approximately ninety degrees is defined between each adjacent pair of the arms.

Regarding FIG. 8, wherein the support chassis 60 is illustrated, the cantilever support 400 includes a riser assembly 402 that is generally vertically disposed, and an extension assembly 440 that is generally horizontally disposed. The extension assembly is unbalanced about the riser assembly and extends away from the riser assembly in unbalanced cantilever fashion. In order to support the ring assembly 300 above the bed plate, the extension assembly extends at least partially toward the central vertical axis 156 that passes through the aperture of the bed plate. The riser assembly 402 has a lower end 408 that is connected to the frame assembly 100. The riser assembly 402 has an upper end 414 that is connected to the extension assembly 440. When assembled with the ring assembly, the extension assembly is further connected to and entirely supports the ring assembly 300. The riser assembly entirely supports the extension assembly and ring assembly 300 in unbalanced cantilever fashion.

The riser assembly 402 is constructed as a grouping of pedestal members 430 that together entirely support the extension assembly 440 and the ring assembly 300. The pedestal members 430 are disposed proximate each other at the single location 102, at which location the riser assembly 402 is connected to the frame assembly 100. The riser assembly entirely supports the extension assembly 440 and the ring assembly 300 in unbalanced cantilever fashion. The extension assembly 440 is constructed as a planar member. More particularly, the extension assembly is constructed as an annular member. The extension assembly 440 is horizontally disposed and centered about the central vertical axis 156 that passes through the aperture of the bed plate.

Advantages of the support chassis 50 and 60, and particularly the cantilever supports 200 and 400 thereof, can be appreciated by considering FIGS. 2, 7, and 8. For example, in FIG. 2 the technician encounters the three upright support members 24 and repeatedly suffers the obstructions they define as he knits down the machine. In FIG. 7, the cantilever support 200 entirely supports the ring assembly 300 and a technician would encounter only the riser assembly 202 (FIG. 6) in knitting down the circular knitting machine 40. Similarly, if a circular knitting machine were assembled about the support chassis 60 in FIG. 8, a technician would encounter only the proximate pedestal members 430 of the riser assembly 402 in knitting down the machine.

Furthermore, in FIG. 2, if the knitting cylinder within the cover assembly 16 is to be removed from the bed plate 12, it is likely that at least one of the upright support members 24 that together surround the knitting cylinder will have to be removed from the knitting machine 10 in order to permit the cylinder to pass outwardly from the machine. During such an operation, an alternative support arrangement, such as an overhead crane or winch, would likely be needed to support the ring assembly 20. In FIG. 7, however, the single cantilever support 200 may permit removal and installation of knitting elements such as the knitting cylinder within the cylindrical cover 46 without significant disassembly or removal of the cantilever support. These descriptions of particular advantages are provided as examples but are not intended and may not be construed as exhaustive descriptions of benefits of the invention.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A support chassis for a circular knitting machine adapted to produce tubular knitted fabric, the support chassis comprising:

a frame assembly including a leg assembly and a horizontal bed plate supported by the leg assembly;

a support connected to the frame assembly; and a horizontal ring assembly capable of supporting multiple yarn feeders above the bed plate for providing yarn for the knitting of tubular knitted fabric, the ring assembly entirely supported by the support in unbalanced cantilever fashion, wherein the support comprises:

a riser assembly connected to the frame assembly, the riser assembly having at least a portion that is at least partially vertically disposed; and an extension assembly connected to the riser assembly, the extension assembly having at a least a portion that is at least partially horizontally disposed, the extension assembly at least partially supporting the ring assembly.

2. The support chassis of claim 1, wherein the extension assembly is unbalanced about the riser assembly and extends away from the riser assembly in unbalanced cantilever fashion.

3. The support chassis of claim 1, wherein the bed plate defines an aperture for the downward passage of tubular knitted fabric, and wherein the extension assembly extends away from the riser assembly and toward a vertical axis that passes through the aperture.

4. The support chassis of claim 1, wherein the riser assembly comprises a single pedestal member that entirely supports the extension assembly and the ring assembly.

5. The support chassis of claim 1, wherein the riser assembly comprises multiple pedestal members that together entirely support the extension assembly and the ring assembly.

6. The support chassis of claim 1, wherein the extension assembly comprises a hub and a plurality of arms connected to and extending radially away from the hub.

7. The support chassis of claim 6, wherein a single one of the arms is connected to the riser assembly such that the extension assembly is entirely supported by the single one of the arms.

8. The support chassis of claim 1, wherein the extension assembly comprises a horizontally disposed planar member.

9. The support chassis of claim 1, wherein the support is connected to the leg assembly independently of the bed plate.

10. The support chassis of claim 1, wherein the leg assembly comprises multiple legs that support the bed plate, and wherein a particular one of the multiple legs comprises an abutment to which the support is connected and by which the support is entirely supported.

11. A support chassis for a circular knitting machine adapted to produce tubular knitted fabric, the support chassis comprising:

a frame assembly including a leg assembly and a horizontal bed plate supported by the leg assembly, the bed plate defining an aperture for the downward passage of tubular knitted fabric;

a cantilever support connected to the frame assembly at a single location, the cantilever support having no portion passing through the aperture; and a horizontal ring assembly capable of supporting multiple yarn feeders above the bed plate for providing yarn for the knitting of tubular knitted fabric, the ring assembly entirely supported by the cantilever support, wherein the cantilever support comprises:

a riser assembly connected at the single location to the frame assembly, the riser assembly having at least a portion that is at least partially vertically disposed; and an extension assembly having at least a portion that is at least partially horizontally disposed, the extension assembly connected to the riser assembly such that the riser assembly entirely supports the extension assembly and the ring assembly.

12. The support chassis of claim 11, wherein the extension assembly is unbalanced about the riser assembly and extends away from the riser assembly in unbalanced cantilever fashion.

13. The support chassis of claim 11, wherein the extension assembly extends away from the riser assembly and toward a vertical axis that passes through the aperture defined by the bed plate.

14. The support chassis of claim 11, wherein the riser assembly comprises a single pedestal member that entirely supports the extension assembly and the ring assembly.

15. The support chassis of claim 14, wherein the single pedestal member comprises a skeletonized frame.

16. The support chassis of claim 11, wherein the riser assembly comprises multiple pedestal members disposed proximate each other, each of the pedestal members attached at the single location to the frame assembly, the pedestal members together entirely supporting the extension assembly and the ring assembly.

17. The support chassis of claim 11, wherein the extension assembly is adjustably connected to the riser assembly such that the extension assembly and the ring assembly are capable of being adjustably disposed along a horizontal axis.

18. The support chassis of claim 11, wherein the extension assembly comprises three horizontally disposed arms connected together in a Y-shaped configuration.

19. The support chassis of claim 18, wherein a particular one of the three arms entirely supports the extension assembly in unbalanced cantilever fashion.

20. The support chassis of claim 11, wherein the leg assembly comprises multiple support legs that together entirely support the bed plate, wherein a particular one of the support legs comprises an abutment disposed at the single location, the abutment entirely supporting the cantilever support and the ring assembly.

* * * * *